United States Patent [19]

Ren et al.

[11] Patent Number: 4,718,838

[45] Date of Patent: Jan. 12, 1988

[54] AUTOCUTTING EXTRUSION MACHINE FOR PRODUCING PRESTRESSED CONCRETE CORED ARTICLES

[75] Inventors: Deguo Ren; Lu Yonghong, both of Fuxing Men, China

[73] Assignee: Building Machines Developing Company of the Ministry of Nuclear Energy Industry, Beijing, China

[21] Appl. No.: 846,028

[22] Filed: Mar. 31, 1986

[30] Foreign Application Priority Data

Apr. 8, 1985 [CN] China ..... 85102514

[51] Int. Cl.[4] ..... B28B 1/08; B28B 3/20

[52] U.S. Cl. ..... 425/64; 425/224; 425/308; 425/432; 425/456

[58] Field of Search ..... 425/62, 63, 64, 113, 425/122, 130, 131.1, 142, 224, 308, 111, 114, 432, 456

[56] References Cited

U.S. PATENT DOCUMENTS

| | | | |
|---|---|---|---|
| 2,853,250 | 9/1958 | Crom | 425/62 |
| 3,143,781 | 8/1964 | Kalns | 425/122 |
| 3,161,117 | 12/1964 | Supject | 425/113 |
| 3,401,438 | 9/1968 | Dennis | 425/130 |
| 3,740,176 | 6/1973 | Nilsson | 425/113 |
| 3,994,639 | 11/1976 | Hewitt | 425/113 |
| 4,084,928 | 4/1978 | Petersik | 425/64 |
| 4,273,522 | 6/1981 | Bunn et al. | 325/113 |

FOREIGN PATENT DOCUMENTS 0080333 11/1982 European Pat. Off. .

*Primary Examiner*—Willard E. Hoag

*Attorney, Agent, or Firm*—Birch, Stewart, Kolasch & Birch

[57] ABSTRACT

The present invention of an extrusion machine for forming prestressed concrete cored slabs includes a mechanism for cutting and core-plugging a molded concrete slab into sections having both ends plugged. The extrusion machine is capable of forming several transverse ribs at intermediate positions along the slab. The mechanism includes a cutting blade, blade cylinder, blade vibrator, supplement feed device, supplement feed plate, supplement feed plate cylinder, a hydraulic system and means for movement of the machine. The extrusion machine is able to produce directly high quality prestressed concrete cored narrow and large size slab units.

10 Claims, 15 Drawing Figures

FIG. 6(a)
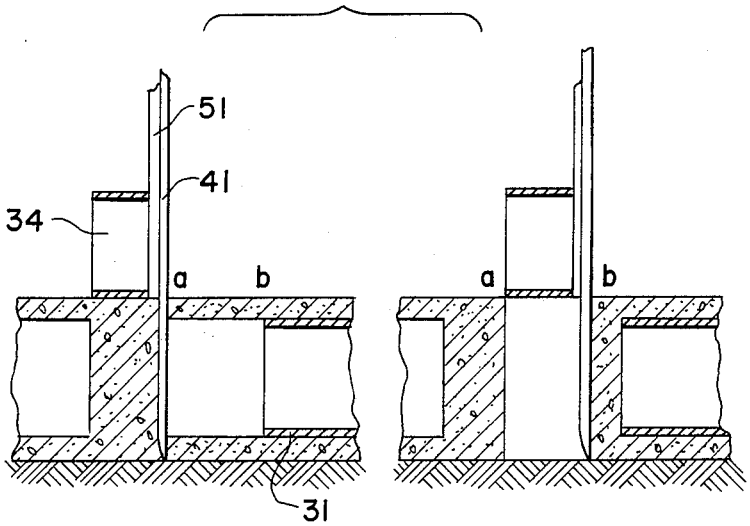
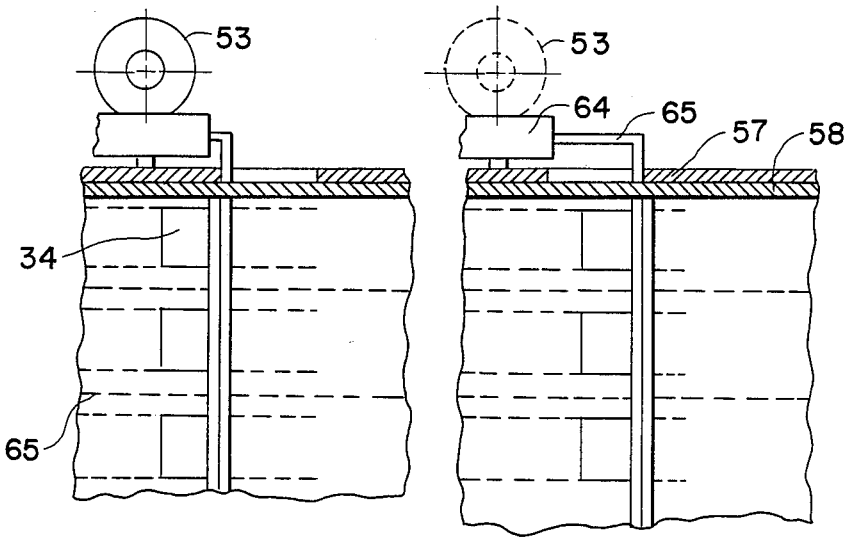
FIG. 6(b)

AUTOCUTTING EXTRUSION MACHINE FOR PRODUCING PRESTRESSED CONCRETE CORED ARTICLES

BACKGROUND OF THE INVENTION

This invention relates to an extrusion machine with a spiral conveyor for forming concrete or other modable materials, and by the addition of a cutting and core-plugging mechanism, being able to produce automatically and directly single (narrow and wide) slabs of the required size and specification.

Prior technology of extrusion machines for producing prestressed concrete cored slabs, and the present invention of an extrusion machine for producing prestressed concrete cored single slabs (including wide slab extrusion machine and narrow slab extrusion machine) have both been used for the production of prestressed concrete cored components. By integrating the delivery, extrusion and vibration processes, concrete slab can be produced requiring no timber, economizing cement and steel consumption, rendering high strength and sound quality as well as raising the working efficiency by 4–6 times in comparison with any other prior methods. The development of extrusion machine creates a requisite for the realization of factory-processing (i.e. so called housing factory) in building construction.

For nearly two decades, many interested parties both in China and abroad, have spent substantial man-power, material and financial resources in actively undertaking the research of an extrusion machine. In the early 1960's, Canada was the first to successfully complete the research in the type of extrusion machine that utilitizes the spiral conveyor for forming concrete components. Since then, the United States, Britain and the Federal Republic of Germany have also achieved successively in their respective researches of the extrusion machines having various characteristics, for which several patents were granted, including those published such as, Canada Patent No. 985191 (1974), U.S. Pat. No. 4,273,522 (1979), European Patent No. 080333 (1982), etc, Nevertheless, there are disadvantages in all of these machines, including: (1) a hopper is incorporated in the machine, that causes vibration to the concrete aggregates and their ultimate agglomeration, and also increase in the weight of machine; (2) specially constructed casting beds are needed, with each being able to produce only one type of slab corresponding in size and specification; (3) a worm gear, worm shaft and chain transmission system is being used resulting in low efficiency of the machine (below 50%); and (4) the high cost of a spiral conveyor which poses a poor economic effect.

In 1977, Ren Deguo et al, of China succeeded in their research for a new type of extrusion machine which overcomes all of the above-mentioned disadvantages. The new machine is provided with the following characteristics: the hopper is separated from the main machine and supported by four posts directly in contact with the ground, with rollers employed for pushing the hopper forward, thus eliminating not only the agglomeration of concrete but also the need of providing any crushing mechanism (or feeding mechanism); by the use of restraining devices in front and at intermediate parts for positioning and guiding of reinforcing steel, and together with the elimination of special casting beds by the substitution of flat concrete ground for production, site utilization rate is upgraded and construction cost is lowered; by using the fully-sealed transmission mechanism with all slanting multi-level deceleration and multi-axial output, efficiency rate of the machine can be greatly upgraded (up to 86%) thus reducing the energy consumption; and the use of a new type of spiral conveyor which is high in strength and well-resistant to wear, with each piece of the conveyor having a performance capacity of 20,000 meters in travelling-distance.

In spite of its many advantages, this new type of extrusion machine is similar to other extrusion machines in that the cored slabs produced are all elongated or continuous plates, whereas the actually required cored slabs are rectangular ones having certain specified lengths. The common practice of dividing the elongated slabs is to cut them into sections corresponding to the desired sizes. Known methods of cutting comprise rigid cutting and soft cutting. Rigid cutting is carried out when concrete reaches its ultimate strength of 70%, and by using a saw-blade formed of welded diamond chips, concrete and the reinforcing steel are cut simultaneously. The disadvantages of this method are: (1) high in cost, (2) without spare of swing-back steel on either ends of the slab, and (3) the susceptibility to cracks due to contraction during the hardening of the elongated slab, resulting in the increase of wastes. Soft cutting, on the other hand, is carried out when the cored slab has just been formed, and with manual operation (by raking or sawing) to divide a part of the concrete component into required sections (reinforcing steel being kept uncut temporarily). The disadvantages of this method are the high consumption of time and labour, the heavy manual work, as well as the nonavailability of the degree of roughness at the ends and discrepancy in size length. Therefore, both methods are not ideal for application.

The width of cored slabs currently in use is basically equal to or smaller than 1.2 meters. By arranging these narrow slabs to form "wide slab" will have the disadvantages of: (1) the discrepancies in prestressing controls existing in different slabs will form a kind of uneven ceiling; (2) grouting of seams is relatively difficult and the appearance of cracks is more common; (3) the efficiencies in transportation and construction are rather low. Large size slabs currently being used in China may overcome certain disadvantages as the above-metioned, but still have the defficiencies of being heavy in weight, high consumption of concrete and steel, as well as low performance in sound and thermal insulation. Thus, the solution of the problem of producing large size cored slabs with a high efficiency machine has become an urgent need to the present day construction industry, and also the one of practical significance.

SUMMARY OF THE INVENTION

An object of the present invention is: by the additional provision of a mechanism with cutting and core-plugging functions so as to enhance the extrusion machine to become capable of automatically and directly producing single slabs (narrow and wide) in comformance with the required size and specification, thus solving the problem existent in the above-mentioned prior technologies. The said mechanism will be able to cut the cored slabs just formed by extrusion into sections, with cores on both ends plugged, and at the same time can have plugs performed at several intermediate places of the wide slab cores, thus forming transverse ribs to function for the fixing and protection of reinforcing steel as well as to increase strength of the wide slab, resulting in the automatic extrusion and forming of large size cored slabs.

The extrusion machine of the present invention for narrow and wide slabs comprises a main electric motor, transmission mechanism, more than one set of conveyor spiral, vibratory elements, hopper and etc., and is characterized by having specifically the cutting and core-plugging mechanism which can cut concrete cored slabs just formed into sections with cores on both ends plugged, and leaving sufficient spare or swing-back steel at both ends in conformance with requirements, thus enhancing the quality of single slabs and the productive efficiency of the machine. In the production of wide slabs, such as slab width surpassing 3.3 meters, besides placing transverse reinforcing steel at the ends and with the ends plugged, transverse steel is also placed at the intermediate positions of the slab and with such positions plugged to form transverse ribs. Such transverse ribs will render the required strength to the wide slabs. The width of a wide slab extrusion machine is determined by the width of the large size cored slabs to be produced, while the number of spiral conveyors to be used may be as much as 30–36. In structure, the wide slab machine essentially resembles that of the narrow slab machine.

The mechanism of cutting and core-plugging for the narrow slab extrusion machine comprises a cutting blade, blade vibrator, blade cylinder, supplement feed device, supplement feed plate, supplement feed cylinder, the hydraulic pressure station and provisions for movement of the cutting blade. The mechanism of cutting and core-plugging for the wide slab machine is slightly different from that for the narrow slab machine, in which the supplement feed device is mounted on the side of the cutting blade whereas that for the wide slab machine is mounted on the bottom of one side of the supplement feed slide plate, the lower end of which is flush with the lower end of the supplement feed device. Such a structure will ensure that when ribs are being formed at the intermediate places of the large slabs, the machine would not cause to cut off the slab formed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(A) shows the front view and FIG. 3(B) shows the side view.

FIGS. 6(A) and (B) show the state where the cutting blade is being moved forward by the machine in two steps.

DETAILED DESCRIPTION OF THE PREFERED EMBODIMENTS p

Figure 1:
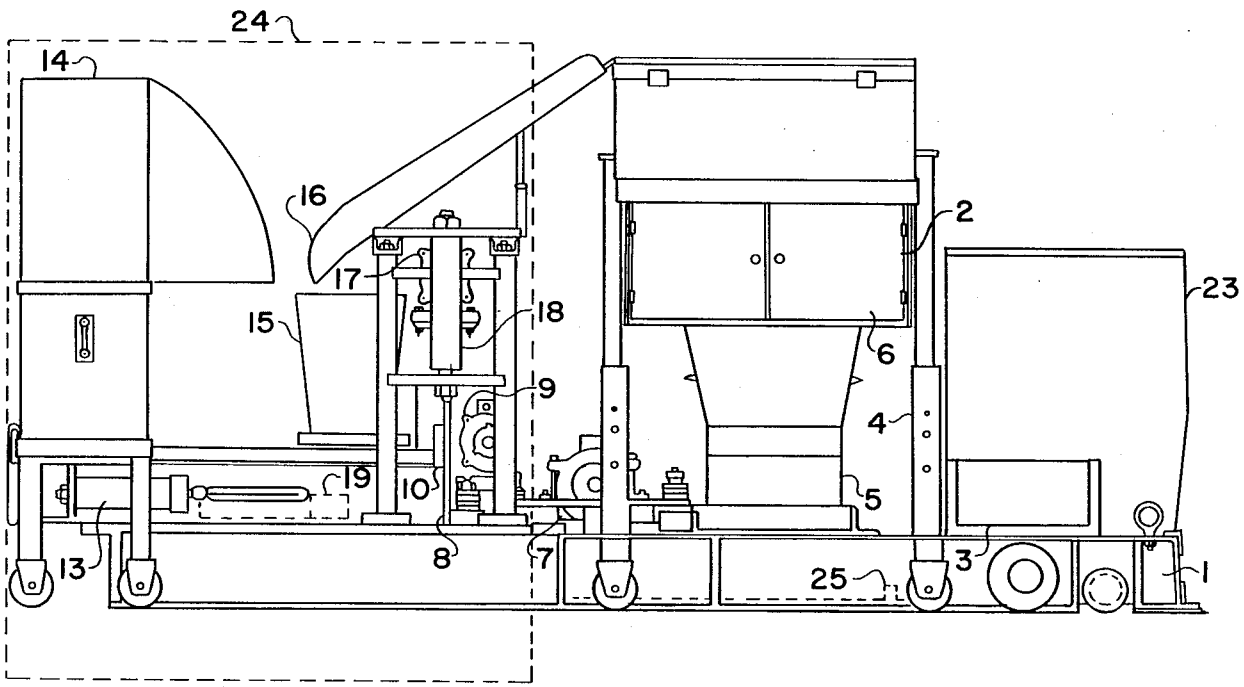
FIG. 1 is a schematic diagram of a narrow slab extrusion machine of the present invention.
Figure 2A:
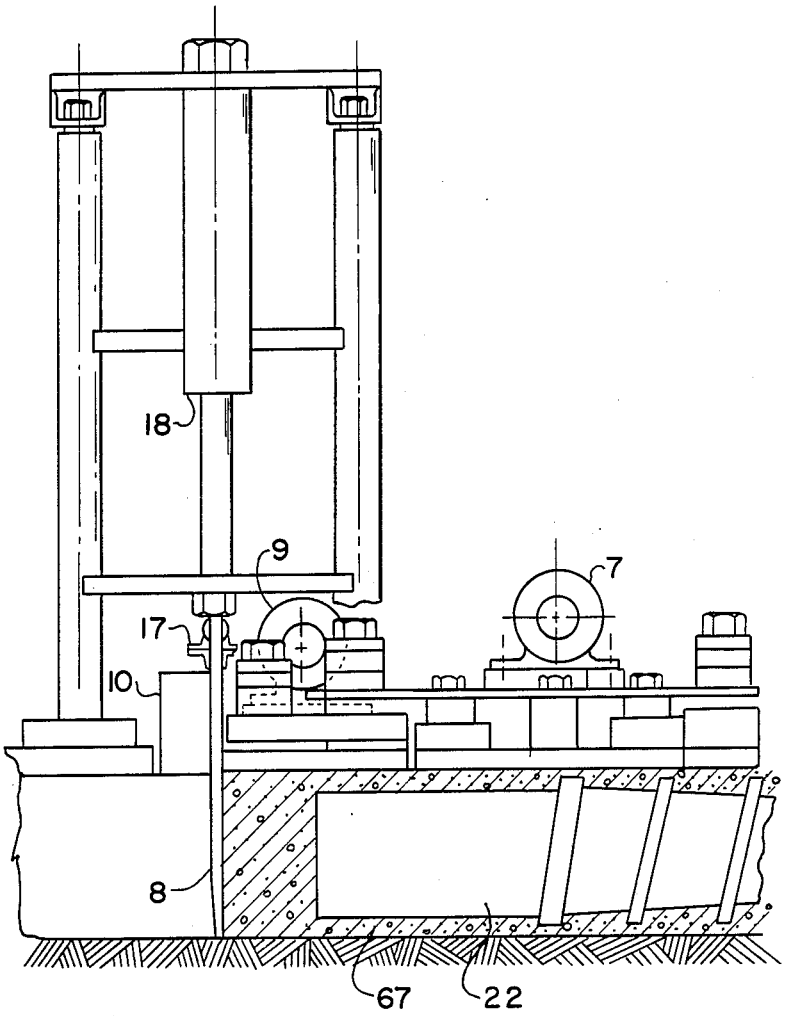
FIGS. 2(A), (B), (C), (D), (E) and (F) are schematic diagrams of the narrow slab extrusion machine. Showing the principles of the cutting and core-plugging operations.
Figure 2:
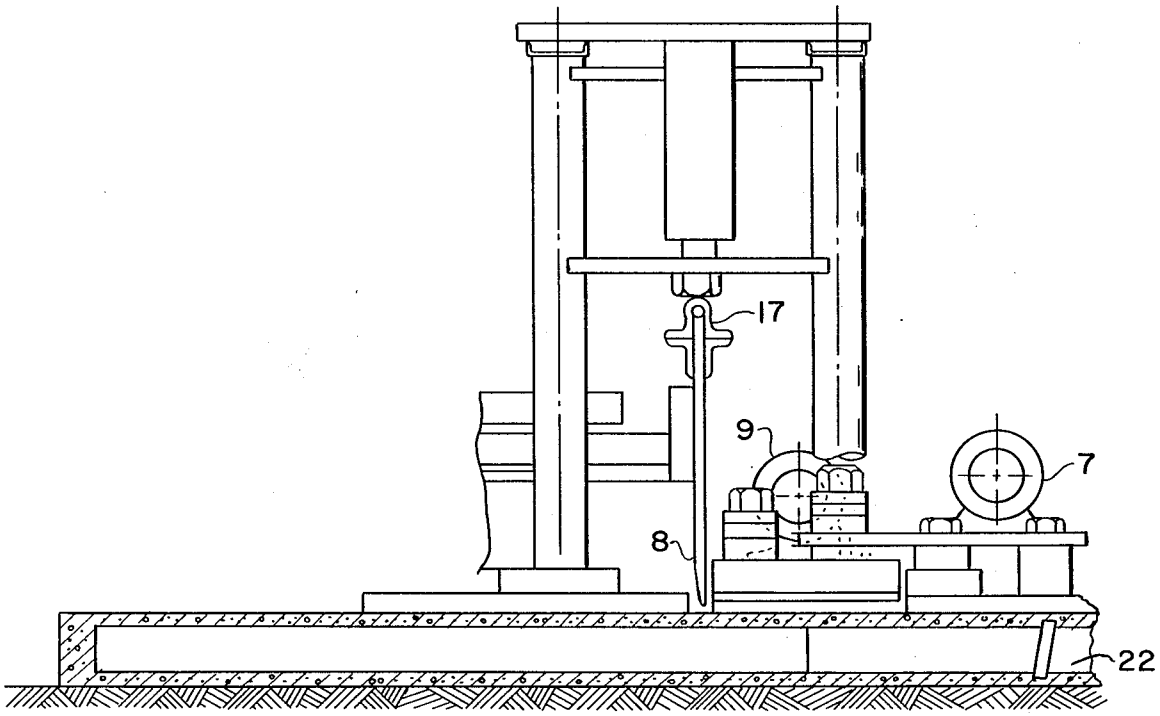

It can be seen from FIGS. 1 and 2 that the narrow slab extrusion machine of the present invention is composed of the main electric motor (23), the transmission mechanism (3), at least one spiral conveyor (22), the vibratory elements (7, 9), position-restraining device (25), the hopper (5), and characterized in that the said cutting and core-plugging mechanism (24) can cut the molded concrete cored slab into sections and with cores on both ends plugged. The said mechanism is in itself composed of the cutting blade (8), blade cylinder (18), blade vibrator (17), supplement feed device (10), supplement-feed plate (19), supplement-feed plate cylinder (13), hydraulic pressure station (14) and the means for movement of the cutting blade. The cutting blade (8) is rigidly connected with the blade cylinder (18), which in turn is rigidly connected with the blade vibrator (17). Both the blade cylinder (18) and the blade vibrator (17) are arranged in parallel on the upper side of the cutting blade (8). The supplement-feed device (10) (spaced apart concrete pressing members) is a metallic container having a rectangular shape and rigidly mounted on one side of the cutting blade and movable following the up and down movement of the above mentioned cutting blade (8). The distance between the lower side of supplement feed device (10) and the blade point is equivalent to the thickness of cored products. The supplement-feed plate (19) is rigidly connected with the supplement feed plate cylinder (13) and located on one side from the cutting blade (8), on top of the machine frame (1). The supplement feed plate cylinder (13) actuates the supplement feed plate (19) to push concrete to the lower side of the supplement-feed device (10).The means for movement of the cutting blade may include the main electric motor (23); or it may include the inner wall plate (20), outer wall plate (21), the cylinder (12) of inner-outer wall plate, as well as the support cylinder (11); or it may include the inner slide plate (26), outer slide plate (27), inner-outer slide plate cylinder (28) and the support cylinder (11).

The transmission mechanism (3) of the present invention of extrusion machine for forming prestressed concrete cored single slab is of the all slanting gear multi-level deceleration and multi-axial output type. The hopper (5) of said extrusion machine is independent of the main machine and supported by four posts (4) directly in contact with the ground and is rolled forward by means of rollers. In FIG. 1, (15) denotes supplement-feed hopper (15), (16) denotes supplement-feed channel (16) 5(A) and (B), and In FIGS. 3(A), 3(B), 4, 6(A) and 6(B) is shown the present invention of an extrusion machine for forming prestressed concrete cored wide slabs comprising main electric motor (52), transmission mechanism (29), multi-piece spiral conveyor (31), vibratory elements (32, 44), position-restraining device (30) and the hopper (45). The machine is characterized by having a cutting and core-plugging mechanism (61) capable of cutting the molded core slabs into sections with cores on both ends plugged and the forming of several ribs in the cored large slabs. The said mechanism (61) comprises the cutting blade (41), cutting blade cylinder (43), blade vibrator (42), supplement feed slide plate (51), the supplement feed slide plate cylinder (39), supplement feed slide plate vibrator (40), supplement feed device (34), supplement feed plate (35), supplement feed plate cylinder (36), the hydraulic pressure station (37), the means for movement of the cutting blade and the supplement-feed hopper (38). The said cutting blade (41) is rigidly connected with the blade cylinder (43), which in turn is rigidly connected with the blade vibrator (42) and they are in parallel arrangement on the upper side of the cutting blade (41). The said supplement feed slide plate cylinder (39) and the supplement feed slide plate vibrator (40) are rigidly connected and mounted on the upper side of the supplement feed slide plate (51), which is in parallel arrangement with the cutting blade (41). The said supplement feed device (34) (spaced apart concrete pressing members) is a metallic container having a rectangular shape rigidly mounted on the bottom end of one side of the supplement feed slide plate (51), with the bottom end of the supplement feed device (34) being flush with the bottom end of the supplement feed slide plate (51). With the wide slab extrusion machine, other forms of arrangement of the supplement feed device is also feasible. For example, by omitting the supplement feed slide plate and with the supplement feed device mounted on the cutting blade as before, but having two positions designed (an upper and a lower one) for its fixing, the said device during the core-plugging in places of the transverse reinforcing steel, can be mounted to and fixed at the lower side of the cutting blade by the operation of the cylinder, and again raised to the original position for plugging of cores on the two ends. The said supplement feed plate (35) and supplement feed plate cylinder (36) are rigidly connected and located at one side from the supplement feed slide plate (51) on top of the machine frame (49), with the supplement feed plate cylinder (36) actuating the supplement feed plate (35) to push concrete to the lower side of the supplement feed device (34). Means for movement of the cutting blade include the main electric motor (52); or inner wall plate (58), outer wall plate (57), inner-outer wall plate cylinder (64) and the support cylinder (53); or the inner slide plate (54), outer slide plate (55), inner-outer slide plate cylinder (56) and the support cylinder (53).

The transmission mechanism (29) of the said wide slab extrusion machine is of the all slanting gear multi-level deceleration and multi-axial output type. The hopper (45) is independent of the main machine with four posts (46) as support having rollers directly placed on the guide rails (48). The machine and hopper will be moved forward by the rollers rolling along the guide rail. Rollers (68) are also installed at the bottom of the machine to enable it to roll on guide rails (48).

In the present invention of a extrusion machine for forming narrow or wide cored slabs of prestressed concrete, the machines have length measuring sensor (2), or the length measuring sensor (47) and the use of micro-computer (6) or the micro-computer (59) for control of the operation process.

Shown in FIG. 1 and FIG. 2(A), (B), (C), (D), (E), and (F) are is the preferred embodiment of an extrusion machine for making prestressed concrete cored single slabs (narrow slab).

In the narrow slab extrusion machine, the production begins with the main electric motor (23) driving the input axial gear to rotate, and through multi-deceleration, input is distributed by the distribution gear into multi-axial output, with the axial output actuating the spiral conveyor (22) to rotate and deliver the aggregates to the rear part. As the concrete aggregates are being delivered to the rear part and go into the bottom part of the main vibrator (7), the main vibrator (7) is started, and through the vibration of which the aggregates are plasticized by the addition of pressure from the spiral surface reduction in space volume of the rear forming cavity (67), denseness of the aggregates will be gradually attained. The force of reaction of aggregates will push the machine forward along an aligned direction due to restraint by position-restraining device (25), and the machine will not run beyond the reinforcing steel. If the aggregates are not well compacted, insufficient force of reaction will result to deter the machine from moving further forward, thus fundamentally assuring the quality of slabs to be produced. Because of independent installation of the hopper (5) from the main machine, a substantial portion of vibration force of the main vibrator (7) will not be transmited to the aggregates in the hopper, with no agglomeration of the aggregates providing, a state of looseness which can be maintained so as to guarantee the free flow of the aggregates with no obstacle into the spiral conveyor (22) and the assurance of continuity of the production. Subsequently, due to the continuous moving forward of the machine, it enables the fabricated slabs to remain on the ground as production proceeds. By using the cutting and core-plugging mechanism (24) of this present invention, slabs may be produced in conformance with the size and specification required with cores on both ends plugged and having the required length of spare swing-back steel provided.

The process of operation for narrow slab extrusion machine is as follows: The cutting blade (8) being driven by the blade cylinder (18) is dropped to the lowest point, and by starting the main motor (23) to actuate the spiral conveyor (22) to rotate, concrete mix will be pressed under the spiral surface, and by vibration of main vibrator (7) making it fully compacted with cores formed. Due to the existence of a certain distance (to be determined in accordance with related stipulations) between the cutting blade (8) and the end of core-forming cylindrical body of the conveyor, when the concrete is being continuously delivered by the conveyor's spiral surface and pressed to the rear, the cutting blade will delay part of the mix which is gradually compacted under the vibration of the secondary vibrator (9) and become solid and thus the formation of plugging at one end (see FIG. 2(A)). When the secondary vibrator (9) ceases to vibrate, the cutting blade (8) will be raised to the highest point with the main vibrator (7) continuing to vibrate and the conveyor (22) continuing to rotate, the machine will move forward; and with the formed slabs remaining on the ground, the fabrication of a substantial length of a slab is completed (see FIG. 2(B)).

Length measuring sensor (2) determines the required length by the pulse counter (each pulse being 0.5 mm. long). According to the pulse counts, the micro-computer (6) signals commands to the main electric motor (23) and the main vibrator (7) for ultimate cessation. Supplement feed plate cylinder (13) actuates the supplement feed plate (19) to push concrete mix to the bottom part of the supplement feed device (10), while the cutting blade cylinder (18) will push the cutting blade (8) and the supplement feed device (10) downward and press the feed supplemented into the cores of slab-end, simultaneously start the blade vibrator (17) mounted on the cutting blade and have the said feed compacted by vibration, thus accomplishing the plugging of the other end of the slab. Meanwhile, the cutting blade (8) have had the slab out, which is to be followed by the next step of moving the cutting blade forward for a certain distance to remove a certain portion of concrete to have been poured, exposing the required length of reinforcing steel so as to realize the aim of separating the whole into two single slabs (see FIG. 2(C), top diagram). From the diagram, it can be seen that the moving of cutting blade (8) from point "a" to point "b" completes the separation of 2 single slabs.

The mechanism for movement of cutting blade comprises the following three types of system:

(I) The main motor driven system. When the cutting blade (8) is lowered and the formed slab has been cut with cores plugged, start the main electric motor (23), simultaneously start the main and secondary vibrators, during the time the reaction exerted by concrete aggregates will force the complete machine to move forward, thus carrying the cutting blade (8) to move forward likewise. The cutting blade (8) will push concrete aggregates in front of it to move forward a certain distance, forming a space interval between two single slabs. In the process of moving forward the cutting blade (8), the conveyor will incessantly deliver concrete aggregates to the rear part to fill up with compactness the cored parts between the conveyor end and the cutting blade, acquiring the aim of core-plugging of the front end of another slab. With the cored space of this section densely filled, the compacted concrete will pose increasingly greater detering force to the cutting blade, so that the main electric motor will stop to operate when the rear part of the machine is lifted a few millimeters up. Next, stop the secondary vibrator, lift the cutting blade (8) and then restart the main electric motor for producing a second slab. The advantages of this system to move cutting blade forwards are that no additional new equipment is needed and the ease in operation; while its disadvantages are the difficulties of controlling the distance of horizontal movement of the cutting blade as well as the limitation of moving distance other than the maximum permissibility.

Figure 2C:
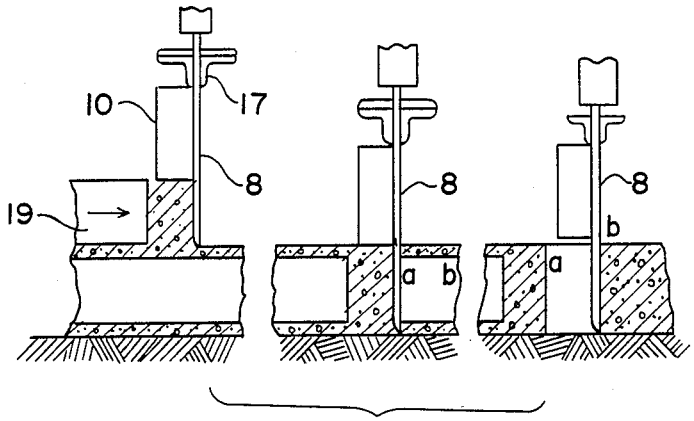
Figure 2D:
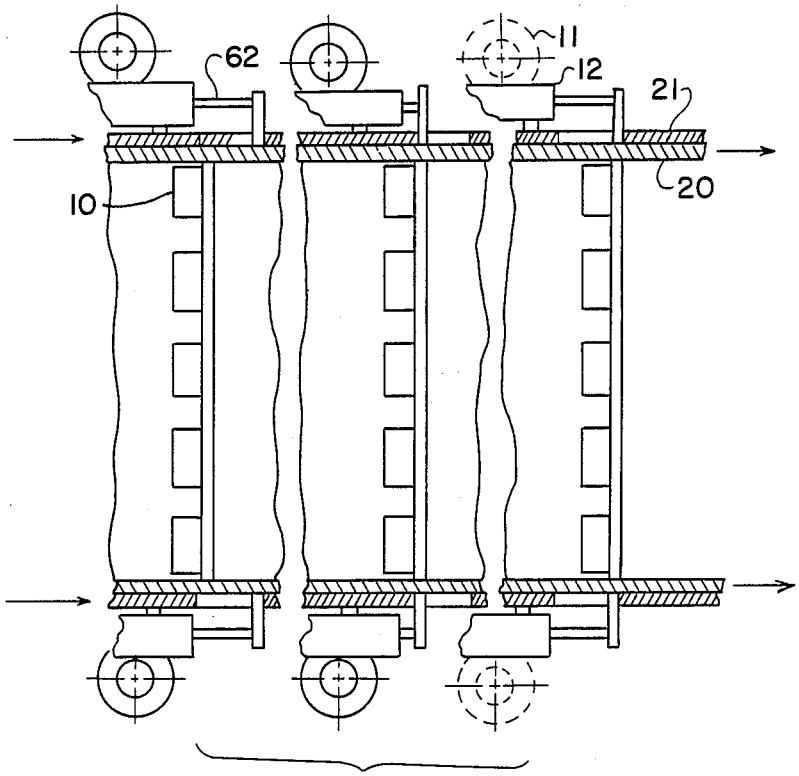
Figure 2:
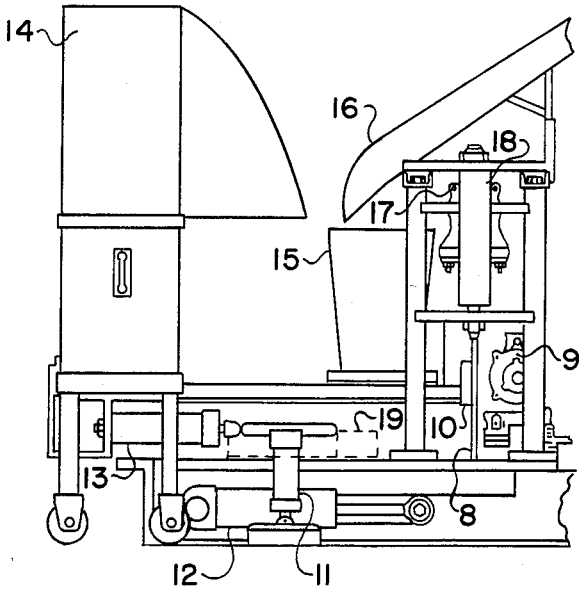

(II) The two-step cylinder driven system. At the lower part of the cutting and core-plugging mechanism (24), a means for movement of the cutting blade is provided, comprising the inner wall plate (20), and outer wall plate (21), the inner-outer wall plate cylinder (12) and the support cylinder (11), (see FIG. 2(C)). The inner wall plate (20) is rigidly connected with the piston rod (62) of the inner-outer wall plate cylinder (12) and the cutting and core-plugging mechanism (24), while the outer wall plate (21) is rigidly connected with the cylinder tube of the inner-outer wall plate cylinder (12) and the front part of the machine, meaning as the whole machine with the exception of cutting and core-plugging mechanism and the support cylinder (11) fixed on the outer wall plate (21). After the completion of core-plugging of the rear end of a single slab the cutting blade (8) is lowered into contact with the ground, with the cutting blade as fulcrum and by starting the inner-outer wall palte cylinder, without moving the inner wall plate for the time being, the cylinder will actuate the outer wall plate and the front part of the machine to move forward a certain distance from "a" to "b" as shown in FIG. 2(C), the length of which will be determined by the space interval required between the single slabs. When by slightly raising the cutting blade to contact no more with the ground, and lowering the support cylinder (11) as shown in FIG. 2(D) by the dotted lines and with the support cylinder as fulcrum, by starting the inner-outer wall plate cylinder (12) without moving the outer wall plate for the time being, the cylinder piston rod (62) will actuate the entire cutting and core-plugging mechanism to move forward, during which moving process the cutting blade will push aside a portion of concrete been formed in the slab, thus resulting in the space interval between two single slabs. Again, by raising the piston rod of support cylinder (11), and starting the main electric motor (23) and the secondary vibrator (9), there will be resulted the fabrication of the front end of another slab. This system has the advantage of precise control over the required length of space interval.

Figure 2F:
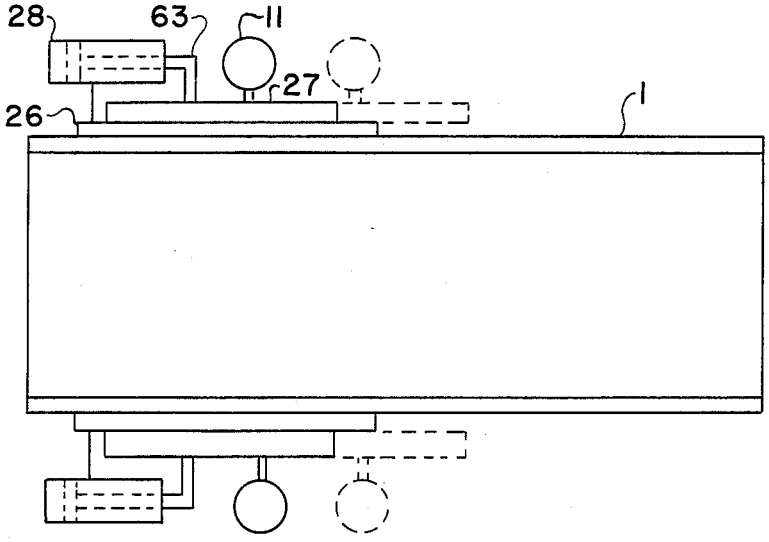
Figure 3A:
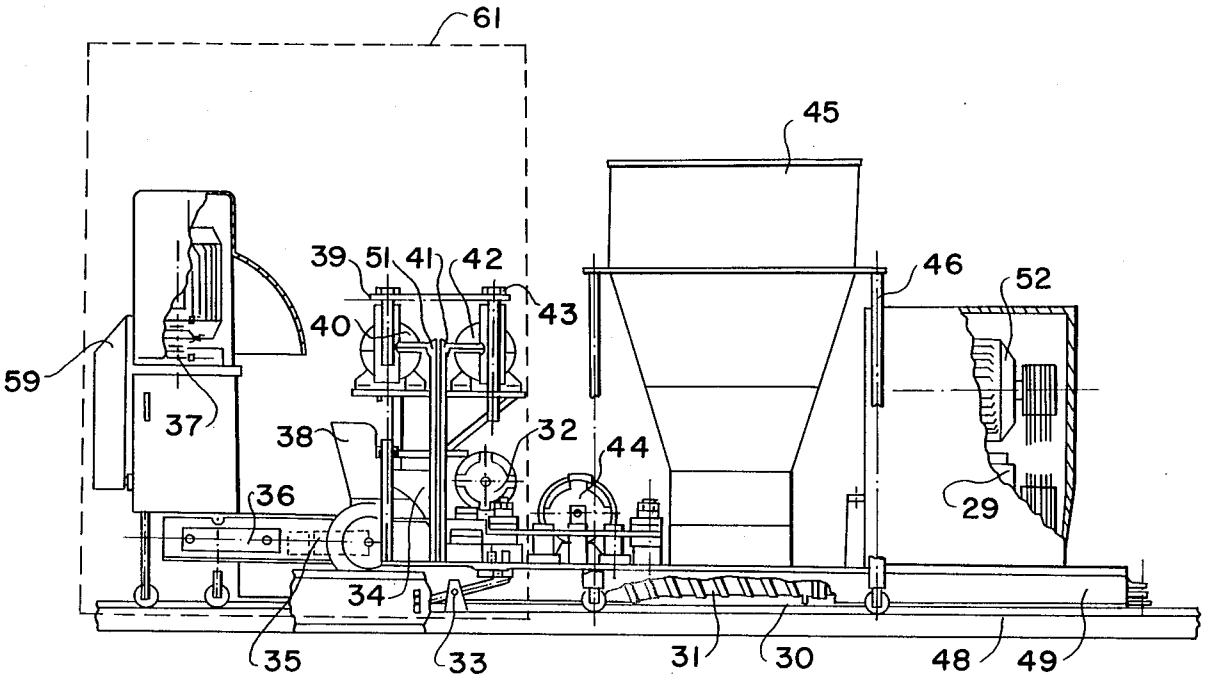
FIGS. 3(A) and (B) are schematic diagrams of the extrusion machine for prestressed concrete large size cored slabs (wide slab)
Figure 3B:
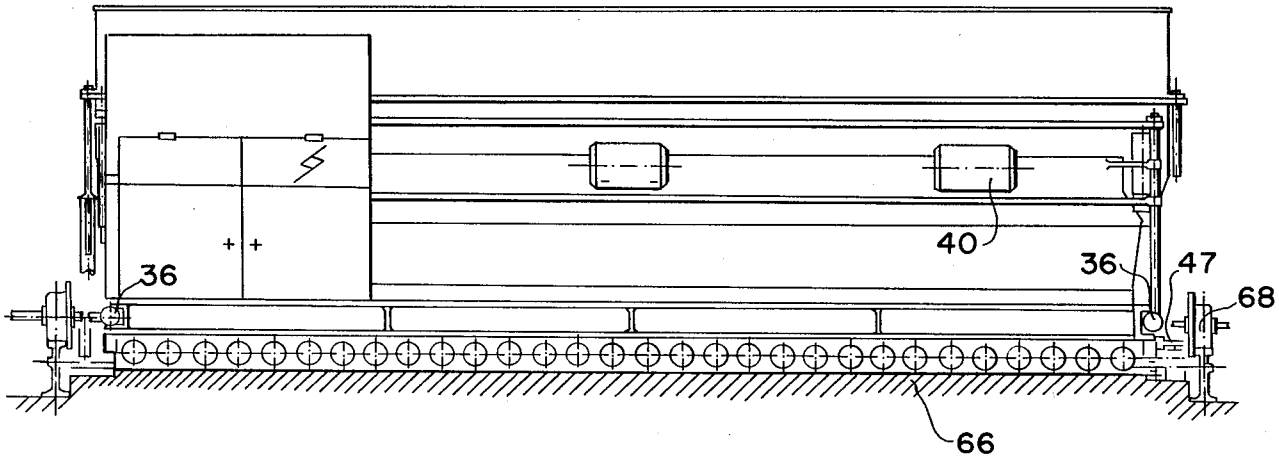
Figure 4:
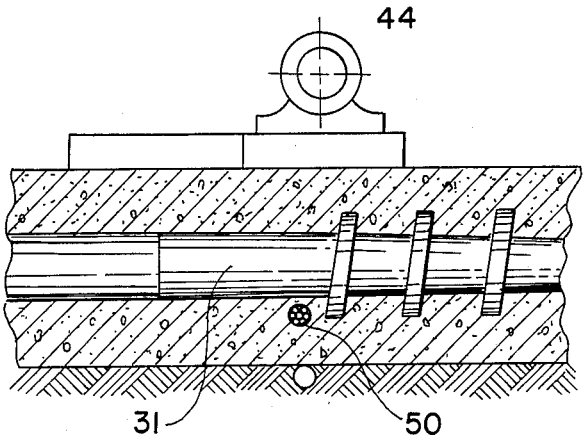
FIG. 4 is a schematic diagram of the placement of transverse reinforcing steel in the prestressed concrete large size cored slabs (wide slab).

(III) The single-step cylinder driven system. A means for movement of the cutting blade are required in this system, comprising the inner slide plate (26), outer slide plate (27), inner-outer slide plate cylinder (28), and the support cylinder (11). The inner-outer slide plates are intergeared and will move in relation with each other, as shown in FIG. 2(F). In the case-example of FIG. 2(F) the inner slide plate (26) is rigidly connected with cylinder tube of inner outer slide plate cylinder (28) and the machine frame (1), the outer slide plate (27) is rigidly connected with the piston rod (63) of the inner-outer slide plate cylinder (28), and the support cylinder (11) is fixed on the outer slide plate (27). After the completion of the cutting and core-plugging of the rear end of a slab, by starting the inner-outer slide plate cylinder (28), the piston rod (63) will push the outer slide plate and the suport cylinder (11) to move a certain distance forward. Then, by lowering the support cylinder (11) to contact ground for establishing the fixed point, and actuating the inner-outer slide plate cylinder (28) the cylinder tube will arise the inner slide plate (26) and the complete machine (also the cutting blade) to move a distance forward, from "c" to "d", as shown in FIG. 2(F), to achieve the goal of dividing the slab into sections. This system of movement of cutting blade, besides being able to precisely control the length of space interval, has also the feature of the absence of relative movement in the forming cavity that avoids the overflow of concrete mixture.

The present invention of narrow slab extrusion machine has the following advantages:

(1) The cutting method employed being high in efficiency (each interval requiring only 30 seconds), low in cost (equivalent to only one tenth of other methods), capable of determining the size of spared swing-back steel at ends according to requirements, and being in conformance with requirements of seismic resistance; (2) both ends of slab being plugged to become solid with much greater compressive strength than required, thus overcoming the defficiencies of current core-plugging practices which do not meet the stipulated requirements; (3) shape of two ends of slabs being able to satisfy various requirements by forming into plane or mechanical-like parts with keyed slots; and (4) the high accuracy in all geometric dimensions, overcoming the disadvantage of old cutting methods that are hardly possible to meet code requirements.

Figure 5A:
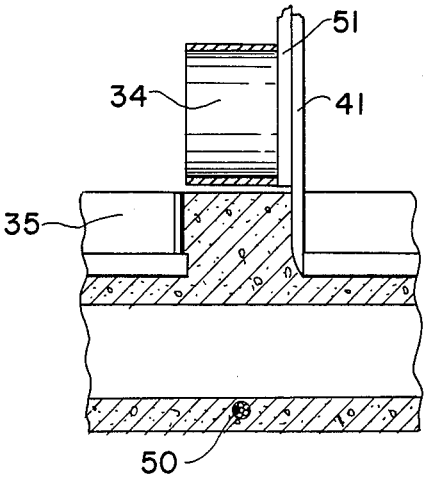
FIGS. 5(A) and (B) are a schematic diagram for supplement feeding of the intermediate ribs in the prestressed concrete large size cored slabs (wide slabs).
Figure 5B:
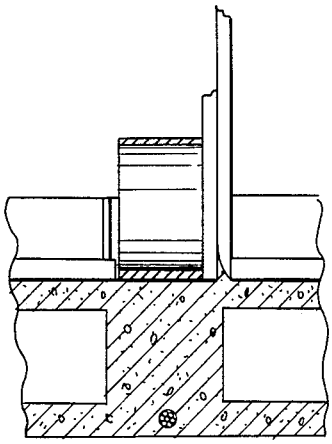

FIGS. 3(A), 3(B), 4, 5A(A) and 5(B), 6(A) and (B) show embodiment of the preferred wide slab extrusion machine. The machine consists of at least two transmission mechanisms (29) parelelly arranged, having multi-axle output, the axles of which will actuate the spiral conveyors to rotate and push the aggregates to the rear part, where the transverse reinforcing steel (50) been prefixed at specified positions. After the completion of core-plugging at the end of a slab, the cutting blade (41) being raised, the machine will move forward along an aligned direction of the longitudinal reinforcing steel (66). When the machine reaches the position of the intermediate transverse steel, a jack rod (33) will lift the transverse steel pre-arranged in contact with the ground to a specified position (see FIG. 4), which process should be done soon after the spiral of the conveyor has passed over the transverse steel, as it is the moment when the pressing force is the greatest, and with the addition of vibration from vibrator, concrete around the transverse steel is of the most sense. As the machine continues to proceed forward and the supplement feed device (34) is just above the steel (FIG. 3(A)), the supplement feed device (34) will function to fill compactly the section of core (about 10 cm wide), as seen in FIG. 5, (A) and 5(B) during which time the cutting blade is not allowed to drop down. With the supplement feed device positioned on top of all the cores, each core will be filled to compactness, forming a strip of ribs. Other cores overlaid with transverse steel are likewise filled compactly as above-mentioned, forming a muti-strip of ribs. When the end cores of a slab are plugged, the cutting blade will have to be moved a distance forward, to form space interval between two single slabs. Like the narrow slab extrusion machine, the wide slab also has three similar types of systems for movement of the cutting blade, including: (I) The main motor drive system, in which, by starting the main motor (52), the complete machine will move forward; and when the cutting blade is moving with the machine, it pushes concrete forward for a certain distance, as can be seen in FIG. 6(A). The principle and process of operation are the same as that of the narrow slab machine.

(II) The two-step cylinder drive system.

This includes a means for movement of the cutting blade at the lower part of the cutting and core-plugging mechanism comprising the inner wall plate (58), outer wall plate (57), inner-outer wall plate cylinder (64) and the support cylinder (53), as can be seen in FIG. 6(A). The structure and operation process of said means are essentially the same as those for the narrow slab machine. The inner wall plate (58) is connected with the piston rod (65) of the inner-outer wall plate cylinder (64) and the cutting and core-plugging mechanism (61). The outer wall plate (57) is connected with the cylinder tube of the inner-outer wall plate cylinder (64) and the front part of the said extrusion machine, and the support cylinder (53) is fixed on the outer wall plate (57). When the cutting and core-plugging of the end of a single slab are completed, with the cutting blade (41) acting as a fulcrum, the inner-outer wall plate cylinder (64) is operated without allowing the inner wall plate to move for the time being, resulting in the cylinder tube driving the outer wall plate and the front part of the machine to move forward for a certain distance, from "a" to "b" (see FIG. 6(A). By lowering the support cylinder (53), with which as fulcurm, starting the inner-outer wall plate cylinder (64), then the piston rod (65) of the cylinder will drive the complete cutting and core-plugging mechanism (61) to move forward, with the cutting blade following as well. The difference of means for movement of cutting blade in wide slab extrusion machine from that narrow slab extrusion machine is that the pushing force of the cylinder employed being much greater.

(III) The single-step cylinder driven system.

Figure 6C:
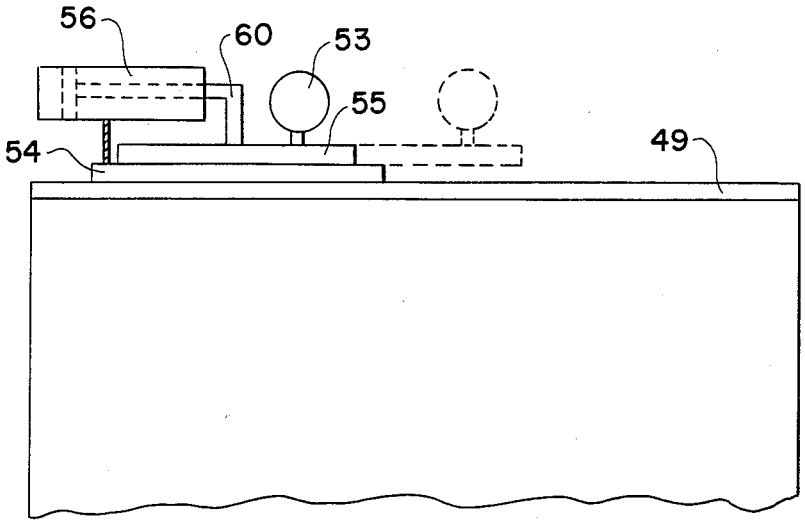
FIGS. 6(A), (B) and (C) are schematic diagrams of the extrusion machine for prestressed concrete cored wide slabs, showing the principles of operation of movement of the cutting blade.
FIG. 6 (B) is the state where the cutting blade is being moved forward by the complete machine.

This has the means for movement of cutting blade, comprising the inner slide plate (54), outer slide plate (55), inner-outer slide plate cylinder (56) and the support cylinder (53), as shown in FIG. 6(C). The structure and operation process are essentially the same as those for the narrow slab, but with the pushing force of the cylinder much greater than that for the narrow slab. The inner slide plate (54) is rigidly connected with the cylinder tube of inner-outer slide plate cylinder (56) and the machine frame (49), while the outer slide plate (55) is connected with the piston rod (60) of inner-outer slide plate cylinder (56), and the support cylinder (53) fixed on the outer slide plate (55). When the cutting and core-plugging at the end of a large size slab are completed, the inner-outer slide plate cylinder (56) will operate the piston rod (60) to push the outer slide plate (55) and support cylinder (53) to move a certain distance forward. Then by lowering the suport cylinder (56) and with which as fulcrum, the cylinder tube of the inner-outer slide plate cylinder will enhance to move the inner slide plate (54) and the complete machine (carrying the cutting blade as well) for a certain distance forward. In FIG. 6A, the no. (66) denotes the longitudinal reinforcing steel.

Large size cored slabs produced by the wide slab extrusion machine have weights less than solid slabs by 40%, with good performances in sound and thermal insulation, as well as an increased production efficiency of over 10 times than that of solid slabs. It is conceivable that with the promotion and application of the said wide slab machine, there will certainly be possible to further reduce the cost of building construction, shorten the construction period and upgrade the construction quality of building structures, thus bringing in new vitality to the further accelerated development of construction industry.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An extrusion machine for making prestressed concrete cored slab sections, said extrusion machine comprising:

movable support means for extruding an outside surface of a molded concrete slab;

a spiral conveyor rotatably mounted to said support means for transferring and compacting concrete within said movable support means and producing cores in said molded concrete slab;

drive means for driving said spiral conveyor, said drive means being supported by said support means;

position-restraining means for guiding said extrusion machine along a pathway on a work surface on which said concrete cored slab is being formed, said position restraining means being operably associated with said movable support means;

a movable hopper for feeding concrete to said movable support means, said movable hopper having support means for providing independent support and movement of said hopper with respect to said movable support means, wherein said movable hopper is operably associated with said support means; and cutting means having core-plugging means attached thereto for cutting said molded concrete slab into sections with said cores of each section being plugged at both ends.

2. The extrusion machine according to claim 1, wherein said cutting and core-plugging means comprises:

a cutter blade slidably mounted on said movable support means;

cutter blade drive means for driving said cutter blade, said cutter blade drive means being mounted to said movable support means;

a cutter blade vibrator; and supplemental concrete feed means for providing additional concrete at positions at said cores where said slab is cut by said cutter blade for plugging said cores.

3. The extrusion machine according to claim 2, wherein said supplemental concrete feed means comprises:

a plurality of spaced apart concrete pressing members mounted to one side of said cutter blade;

a supplement feed plate for transferring additional concrete to said concrete pressing members, said supplement feed plate being slidably mounted to said movable support means; and a supplement feed plate drive means for driving said supplement feed plate, said supplement feed plate drive means being mounted to said movable support means.

4. The extrusion machine according to claim 2, wherein said supplemental concrete feed means comprises:

a supplement feed slide plate slidably mounted to said movable support means adjacent said cutter blade, said supplement feed slide plate having a plurality of spaced apart concrete pressing members mounted to one side of said supplement feed slide plate;

a supplement feed slide plate drive means for driving said supplement feed plate, said supplement feed plate drive means being mounted to said movable support means;

a supplement feed slide plate vibrator;

a supplement feed plate for transferring additional concrete to said concrete pressing members, said supplement feed plate being slidably mounted to said movable support means; and a supplement feed plate drive means for driving said supplement feed plate, said supplement feed plate drive means being mounted to said movable support means.

5. The extrusion machine according to claim 3, wherein said concrete pressing members are mounted from a cutting edge of said cutter blade a distance equal to a thickness of said concrete cored slab being formed by said extrusion machine.

6. The extrusion machine according to claim 4, wherein said concrete pressing members are mounted from a cutting edge of said cutter blade a distance equal to a thickness of said concrete cored slab being formed by said extrusion machine.

7. The extrusion machine according to claim 1, wherein said support means of said movable hopper comprises four posts each having a roller for contacting the work surface.

8. The extrusion machine according to claim 1, including a concrete cored slab length measuring sensor and a microcomputer for controlling the operation of said extruding machine including movement, slab extruding, slab coring, and slab cutting operations of said extrusion machine.

9. The extrusion machine according to claim 1, wherein said movable support means includes an inner wall plate slidably disposed within an outer wall plate wherein said inner wall plate supports said cutting and core-plugging means; and said extrusion machine further includes an inner-outer wall plate cylinder connected at one end in said inner wall plate and at another end to said outer wall plate having a work surface engaging support, whereby said inner-outer wall plate cylinder can be operated after a cutting and plugging operation, performed on said slab producing a plugged section of said slab, by said cutting and core-plugging means for providing a separation between said section and said slab being extruded and for plugging a leading edge of said slab being extruded.

10. The extrusion machine according to claim 1, wherein said movable support means includes an inner slide plate mounted stationary with respect to said movable support means;

an outer slide plate slidably connected to said inner slide plate, said outer slide plate having a work surface engaging support; and an inner-outer slide plate cylinder connected at one end to said inner slide plate and at another end to said outer slide plate, whereby said inner-outer slide plate cylinder can be operated after a cutting and plugging operation, performed on said slab producing a plugged section of said slab, by said cutting and core-plugging means for providing a separation between said section and said slab being extruded and for plugging a leading edge of said slab being extruded.

* * * * *

UNITED STATES PATENT AND TRADEMARK OFFICE

CERTIFICATE OF CORRECTION

PATENT NO. : 4,718,838

DATED : January 12, 1988

INVENTOR(S) : Deguo REN

It is certified that error appears in the above—identified patent and that said Letters Patent is hereby corrected as shown below:

On the Title Page, change the name of the patentee from "Ren et al" to -- Ren --

In the heading of the patent, under the category "[75] Inventors:" change "Deguo Ren, Lu Yonghong, both of Fuxing Men, China" to
-- Deguo Ren, of Fuxing Men, China --

Signed and Sealed this

Twenty-third Day of August, 1988

*Attest:*

*Attesting Officer*

DONALD J. QUIGG

*Commissioner of Patents and Trademarks*